United States Patent [19]

Gulya

[11] Patent Number: 4,764,417

[45] Date of Patent: Aug. 16, 1988

[54] PIN SEAMED PAPERMAKERS FELT HAVING A REINFORCED BATT FLAP

[75] Inventor: Thomas G. Gulya, Appleton, Wis.

[73] Assignee: Appleton Mills, Appleton, Wis.

[21] Appl. No.: 59,421

[22] Filed: Jun. 8, 1987

[51] Int. Cl.[4] ..... D03D 13/00

[52] U.S. Cl. ..... 428/222; 28/141; 162/358; 162/DIG. 1; 428/223; 428/234; 428/300

[58] Field of Search ..... 139/383 AA; 162/DIG. 1, 162/358; 428/234, 300, 222, 223; 28/110, 141

[56] References Cited

U.S. PATENT DOCUMENTS

| | | | |
|---|---|---|---|
| 3,815,645 | 6/1974 | Cordonlu | 139/383 |
| 4,095,622 | 6/1978 | MacBean | 139/383 |
| 4,123,022 | 10/1978 | Dutt et al. | 245/10 |
| 4,401,137 | 8/1983 | Cannon | 139/383 |
| 4,425,392 | 1/1984 | Oikawa | 428/90 |
| 4,601,785 | 7/1986 | Lilja | 162/199 |

*Primary Examiner*—James J. Bell

*Attorney, Agent, or Firm*—Andrus, Sceales, Starke & Sawall

[57] ABSTRACT

A papermakers felt composed of a pin seam base fabric and a needled batt and having a reinforced batt flap covering the pin seam. The ends of the woven base fabric are provided with interdigitated loops which are connected by a pin to form a pin seam joint. A layer of machine direction yarns are disposed on a face of the base fabric and extend across the joint. A fibrous batt is needled into the base fabric and machine direction yarns. To install the felt on a papermaking machine, the batt is slit at a location spaced from the joint and the portion of the batt between the slit and the joint is pulled away from the base fabric to provide a flap. The machine direction yarns are separated from the base fabric along with the batt and serve to reinforce the batt flap, preventing the flap from tearing away from the felt.

11 Claims, 1 Drawing Sheet

PIN SEAMED PAPERMAKERS FELT HAVING A REINFORCED BATT FLAP

BACKGROUND OF THE INVENTION

Pin seam fabrics for use on papermaking machines are composed of a woven base fabric and the ends of the base fabric are provided with interdigitated loops that are connected by a removable pin. The base fabric can either be woven in endless form as disclosed in U.S. Pat. No. 3,815,645 or alternately, can be woven in flat form in which case loops are subsequently attached to the free ends of the fabric in a manner such as disclosed in U.S. Pat. Nos. 4,123,022 and 4,401,137.

U.S. Pat. No. 4,601,785 discloses a pin seam base fabric having a fibrous batt needled onto the base and which can be used as a felt in the press section of a papermaking machine. With the felt as produced by the aforementioned patent, the fibrous batt is needled onto a face of the base fabic while the base fabric is in endless form and the needled batt extends across the pin seam joint. To open the felt fo installation on a papermaking machine, the batt is slit at a location spaced from the pin seam joint, and the portion of the batt extending between the slit and the joint is pulled away or separated from the base fabric to provide to batt flap. The pin is then removed from the pin seam joint and the felt is opened to a flat condition so that it can be installed on the papermaking machine. After installation, the pin is reinserted within the interdigitated loops and the batt flap is secured to the base fabric either by adhesives or needling.

The construction in U.S. Pat. No. 4,601,785 has a distinct drawback in that the flap can be easily torn away from the remainder of the needled batt as it is separated from the base fabric due to the fact that the flap is only attached to the remainder of the batt by its own relatively short fibers. If the flap is torn away, it is difficult, if not impossible, to reapply the flap to the base fabric after installation of the felt on the papermaking machine and yet maintain a uniform density of the felt in the area of a reapplied flap as compared to the remainder of the felt. A nonuniform density can adversely effect the water extraction characteristics of the felt. The re-attached flap also has a tendency to tear away during operation on the papermaking machine.

SUMMARY OF THE INVENTION

The invention is direct to a papermakers felt, comprising a woven base fabric with interdigitated loops at the ends of the fabric joined by a pin to form a pin seam joint. A layer of machine direction yarns is disposed of a face of the base fabric and extends across the joint. The machine direction yarns can be interwoven with the base fabric or secured to the base fabric by interweaving with thin auxilliary cross direction yarns.

A batt of fibrous material is then needled through the machine direction yarns and into the base fabric.

To install the felt on the papermaking machine, the batt is slit at a location spaced from the pin seamed joint and the portion of the batt extending between the slit and the joint is peeled away from the base fabric to provide a flap. As the machine direction yarns are separated from the base fabric along with the flap, the machine direction yarns act to reinforce the flap and prevent the flap from being torn away from the remainder of the needled batt.

After the flap is peeled back, the pin is removed from the loops and the felt can be opened and installed on the papermaking machine. Following installation, the pin is reinserted through the interdigitated loops and the batt flap can be resecured to the base fabric by adhesives or needling.

With the construction of the invention, the batt flap is reinforced by the auxiliary machine direction yarns so that there is no danger of the flap being torn away from the remainder of the batt. Consequently, when the felt is installed on the papermaking machine, the felt will have a substantially uniform density throughout its length, including the area of the pin seam joint and the batt flap.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
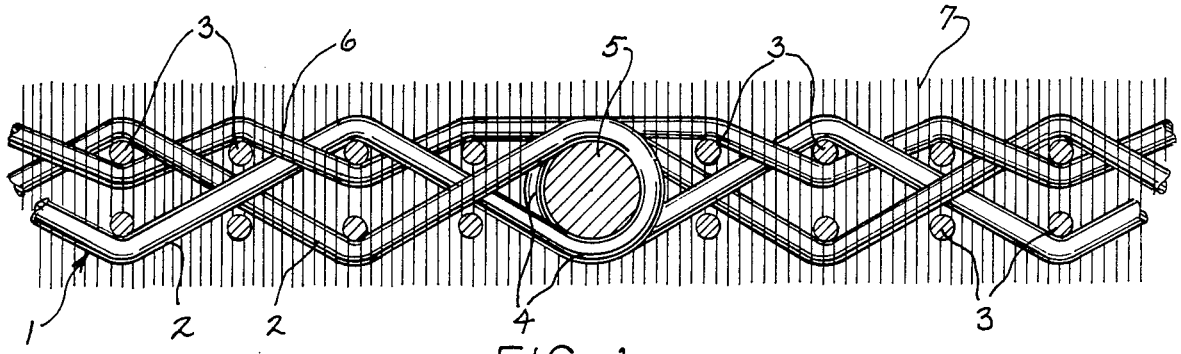
FIG. 1 is a diagramatic cross section of the papermakers felt of the invention.

The drawings diagrammatically illustrate a papermakers felt including a woven base fabric 1 formed of machine direction yarns 2 and cross yarns 3. The machine direction yarn 2 and cross yarns 3 can be formed of monofilaments, multifilaments or staple yarns and consist of synthetic or natural fibers or mixtures thereof.

The ends of the base fabric are provided with a plurality of interdigitated loops 4 which are connected by a pin or pintle 5. The base fabric can be woven either in flat form and thereafter separate loops can be interwoven with the cross direction yarns adjacent the ends of the fabric, as disclosed in U.S. Pat. Nos. 4,123,022 or 4,401,137, or alternately, the base can be woven in endless form in which the loops are integrally formed with the fabric as disclosed in U.S. Pat. No. 3,815,645.

While the drawings show a base fabric formed of a double layer of second machine direction and cross direction yarns, it is contemplated that the base fabric can also be a single or multiple layer fabric.

In accordance with the invention, machine direction yarns 6 are applied to a face of the base fabric. As illustrated, yarns 6 are interwoven with cross yarns 3 and are in parallel relation and are spaced across the entire width or cross direction of the base fabric. The yarns 6 extend throughout the entire length of the base fabric and are preferably formed of continuous synthetic filaments.

Alternately, the machine direction yarns 6 can be held in position with respect to the base fabric by auxiliary cross direction yarns which can be overlayed or interwoven with the machine direction yarns 6. Yarns 6 are formed of monofilaments, multifilaments or staple yarns and consist of synthetic or natural fibers.

The base fabric 1 is installed on a needling machine in endless form with pin 5 inserted in interdigitated loops 4 and yarns 6 applied to the outer face of the fabric. A fibrous batt 7 is then needled onto the face of the base fabric by conventional needling techniques. The needling of the batt 7 extends throughout the length of the fabric and across the pin seam joint 5.

The batt 7 may be composed of synthetic or natural fibers or mixtures thereof, and the needling interconnects the relatively short fibers of the batt with the yarns 6 as well as the base fabric 1.

Figure 2:
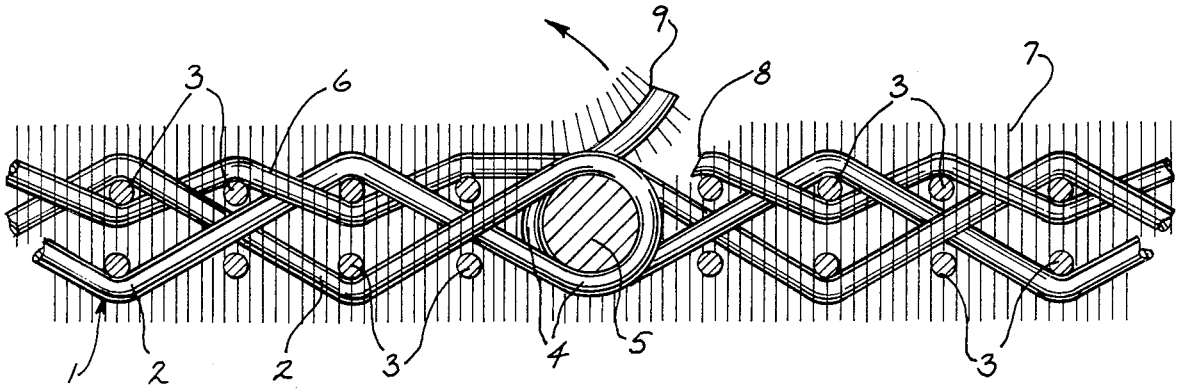
FIG. 2 is a view similar to FIG. 1 showing the batt slit and a batt flap separated from the base fabric.
Figure 3:
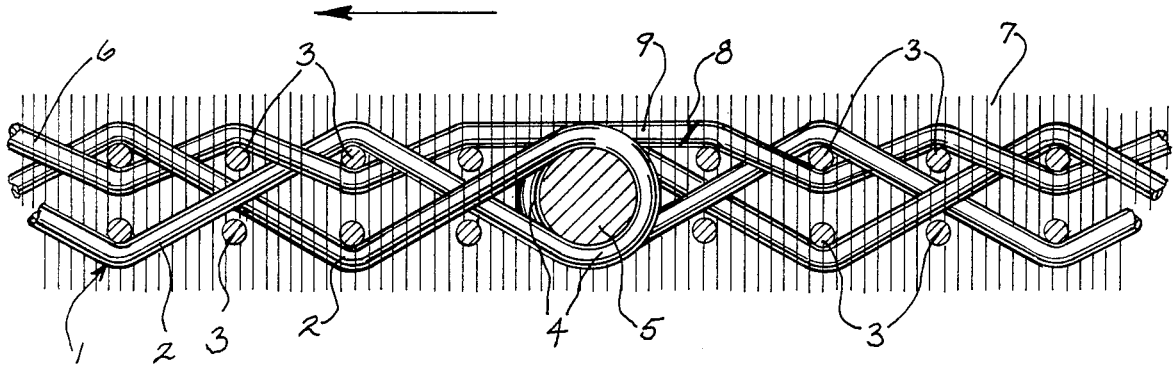
FIG. 3 is a view similar to FIG. 1 showing the felt as installed on the papermaking machine with the batt flap reattached to the base fabric.

To install the felt on a papermaking machine, the felt, in endless form after needling, is slit transversely, as indicated by 8, at a location offset in the machine direction from the pin seam joint 5 to sever the yarns 6. The slit 8 is preferably made at an acute angle to the face of the batt 7, so that when the felt is subsequently installed on the papermaking machine the outer extremity of slit 8 will be located downstream, in the direction of travel of the felt, from the inner extremity of the slit. The portions of the yarns 6, along with the integrated batt, extending between slit 8 and the interdigitated loops 4 is pulled back from the base fabric 1 to provide a batt flap 9. As the machine direction yarn 6 are interwined with the batt 7 through the needling, the yarns 6, as well as any auxiliary cross yarns used to position yarns 6 on fabric 1, will be pulled away from the base 1 along with flap 9 as shown in FIG. 2, so that the yarns 6 serve to reinforce the flap and prevent the flap from being torn completely away or separated from the remainder of the batt 7.

After separation of the flap 9, pin 5 is removed from the loops 4 to permit the felt to be opened and the felt can then be installed on the papermaking machine. After installation, the pin 5 is reinserted in the interdigitated loops 4 and the batt flap 9 can, if necessary, be reattached to the base fabric 1 by adhesives, needling or any other desired manner. As the batt extends continuously across the pin seam joint without interruption, the density of the felt in the area of the joint will be uniform.

The use of the machine direction yarns 6 provides a reinforcement for the separated batt flap 9 to prevent the flap from being separated or torn away from the remainder of the batt. As the yarns 6 preferably extend throughout the entire length of the felt, the use of the yarns 6 will not alter the uniform density of the felt.

Various modes of carrying out the invention are contemplated as being within the scope of the following claims particularly pointing out and distinctly claiming the subject matter which is regarded as the invention.

I claim:

1. A method of producing and installing a pin seam felt on a papermaking machine, comprising the steps of forming a base fabric having interdigitated loops at its ends joined by a pin to provide an endless fabric, applying machine direction yarns to a face of said fabric and across the pin seam joint, needling a batt of fibrous material to said face to intertwine said fibrous material with said machine direction yarns and said base fabric, cutting the batt and said yarns transversely at a location spaced from said joint, separating a portion of the batt and said yarns extending from said location to adjacent said joint to provide a batt flap, removing said pin from said loops to enable said felt to be opened, installing the open felt on a papermaking machine and interdigitating said loops, and inserting said pin into the interdigitated loops.

2. The method of claim 1 wherein the step of forming said base fabric comprises interweaving warp and weft yarns to form said fabric.

3. The method of claim 1 wherein said machine direction yarns extend continuously throughout the entire length of said base fabric.

4. A method of producing and installing a pin seam felt on a papermaking machine, comprising the steps of forming a base fabric by interweaving first machine direction yarns and cross direction yarns, forming interdigitated loops at the ends of said fabric joined by a pin to provide a pin seam joint, applying a group of second machine direction yarns separate from said first machine direction yarns to a face of said fabric and extending said second machine direction yarns continuously across said pin seam joint, needling a batt of fibrous material to said face to intertwine said fibrous material with said second machine direction yarns and said base fabric, cutting the batt and said second machine direction yarns transversely at a location spaced from said joint, separating a portion of the batt and said yarns extending from said location to adjacent said joint to provide a batt flap, and removing said pin from said loops to enable said felt to be opened.

5. The method of claim 4, wherein said step of applying said second machine direction yarns comprises interweaving said second machine direction yarns with said cross yarns.

6. A papermakers felt comprising, a woven base fabric with the ends of the base fabric having interdigitated loops, a pin disposed in the loops to form a pin seamed joint, a plurality of machine direction yarns disposed on a face of said fabric and extending continuously across said joint, a batt of fibrous material needled into said base fabric and into said machine direction yarns, said batt and said yarns being slit transversely at a location spaced from said joint, the portion of the batt extending between said slit and said joint constituting a separable flap, a portion of said machine direction yarns being integrally attached to said flap and separable from said base fabric with said flap, and means for adhering the flap to said base fabric.

7. The felt of claim 5 wherein said machine direction yarns are formed of a synthetic material.

8. The felt of claim 4 wherein said machine direction yarns extend continously throughout the length of said base fabric.

9. The felt of claim 6, wherein said base fabric is composed of interwoven warp yarns and weft yarns, said machine direction yarns being interwoven with said weft yarns.

10. A papermakers felt comprising, a woven base fabric with the ends of the base fabric having interdigitated loops, a pin disposed in the loops to form a pin seamed joint, a plurality of machine direction yarns disposed on a face of said fabric, said yarns extending continuously throughout the length of said base fabric and disposed across said joint, a batt of fibrous material needled into said base fabric and into said machine directional yarns, said batt extending continuously throughout the length of said base fabric and being slit transversely, said slit being at an acute angle to said face of said fabric and being spaced in the machine direction from said joint, the portion of the batt extending between said slit and said joint constituting a separable flap, the portion of the machine direction yarns disposed between said slit and said joint being integrally connected to said flap and separable from said base fabric with said flap.

11. The felt of claim 10, and including means for retaining said yarns in spaced relation on said base fabric prior to needling said batt to said base fabric.

* * * * *